US005802678A

United States Patent [19]

Puente

[11] Patent Number: 5,802,678

[45] Date of Patent: Sep. 8, 1998

[54] NON-PENETRATING TIE RESTRAINING DEVICE

[76] Inventor: Joe A. Puente, 5941 Vista Dr., Apt. 412, West Des Moines, Iowa 50266

[21] Appl. No.: 895,227

[22] Filed: Jul. 16, 1997

[51] Int. Cl.[6] ..... A41D 25/00

[52] U.S. Cl. ..... 24/49.1; 24/51; 24/66.2

[58] Field of Search ..... 24/49.1, 51, 65, 24/55, 53, 54, 66.2, 66.1, 66.11

[56] References Cited

U.S. PATENT DOCUMENTS

| | | | |
|---|---|---|---|
| D. 272,014 | 1/1984 | Mitcham et al. | D2/420 |
| D. 331,374 | 12/1992 | Moore, III | D11/222 |
| D. 336,867 | 6/1993 | Wright | D11/203 |
| 2,003,740 | 6/1935 | Cohn | 24/66.2 |
| 2,181,443 | 11/1939 | Zeman | 24/66.2 |
| 2,586,215 | 2/1952 | Federico | 24/49 |
| 3,357,063 | 12/1967 | Eiben | 24/49 |
| 3,453,693 | 7/1969 | Woodhead | 19/159 |
| 3,535,748 | 10/1970 | Lely | 24/66.2 |
| 4,123,824 | 11/1978 | Roberts | 24/49 CP |
| 4,554,710 | 11/1985 | Grant | 24/49 CF |
| 5,097,569 | 3/1992 | Erickson | 24/49 R |

FOREIGN PATENT DOCUMENTS

| | | | |
|---|---|---|---|
| 0712872 | 8/1954 | United Kingdom | 24/49.1 |

*Primary Examiner*—Victor N. Sakran
*Attorney, Agent, or Firm*—John D. Gugliotta

[57] ABSTRACT

A tie restraining device for use with conventional neckwear is disclosed having an elongated tie restraining clamp for clipping around a tie in a non-penetrating manner.

5 Claims, 4 Drawing Sheets

NON-PENETRATING TIE RESTRAINING DEVICE

RELATED APPLICATIONS

The present invention is a continuation of Disclosure Document Number 408,396 filed on Oct. 30, 1996.

BACKGROUND OF THE INVENTION

1. Field of the Invention

The present invention relates generally to necktie restraining tacks and, more particularly, to a non-penetrating tie restraining device that restrains a necktie without penetrating the necktie.

2. Description of the Related Art

A search of the prior art did not disclose any patents that read directly on the claims of the instant invention; however, the following references were considered related:

| U.S. Pat. No. | Inventor | Issue Date |
|---|---|---|
| 5,097,569 | Ronald A. Erickson | Mar. 24, 1992 |
| 4,554,710 | Charles R. Grant | Nov. 26, 1985 |
| 4,123,824 | Herbert B. Roberts | Nov. 7, 1978 |
| 3,453,693 | Robert Henry Woodhead | Apr. 13, 1966 |
| 3,357,063 | Casper Melvin Eiben | Dec. 12, 1967 |
| 2,586,215 | Joseph B. Federico | Feb. 19, 1952 |
| D336,867 | Norbert Wright | Jun. 29, 1993 |
| D331,374 | Earl L. Moore, III | Dec. 1, 1992 |
| D272,014 | William D. Mitcham | Jan. 3, 1984 |

As is well-known in the art, conventional tie clips are well known in two basic types. The first type is a tie pin which penetrates the fabric of the tie, and possibly the shirt as well, and is received in a clamping retainer to prevent injury. Variations of this type are utilized in some respect in U.S. Pat. No. 5,097,569, in U.S. Pat. No. 4,123,824, and in U.S. Pat. No. 3,357,063.

The second type is a tie clip that uses a springed hinge (envisionable as an alligator type clip) to clip a tie to a shirt.

Clips of the first type penetrate the tie and form holes in the material. Clips of the second type can easily slip and/or look untidy and awkward.

Of considerable relevance are those disclosures that attempt to combine beneficial features of each of these types. While combinations of clipping and clamping features are incorporated into this invention in combination, other elements are different enough as to make the combination distinguished over the above listed art.

SUMMARY OF THE INVENTION

It is therefore an object of the present invention to provide an improved tie restraining device.

It is a feature of the present invention to provide an improved tie restraining device that clips around a tie and holds the tie in place without punching holes in it.

In accordance with a preferred embodiment, a tie restraining device is provided that securely holds tie and clip to a shirt. A safety stick pin is provided at the rear of the clip, and a stick-pin cover protects the wearer from the pin. An elongated tie restraining device clips around the tie, and supports a front surface capable of being formed into a variety of styles and designs, or affixed to a number of differently styled detachable fascias.

Advantages of the present invention are that a user's tie will not slip to awkward angles and will always looks neat.

Further, the present invention can fit a variety of tie widths, and can conform with a variety of fashion styles, and can be changed to a variety of emblems.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
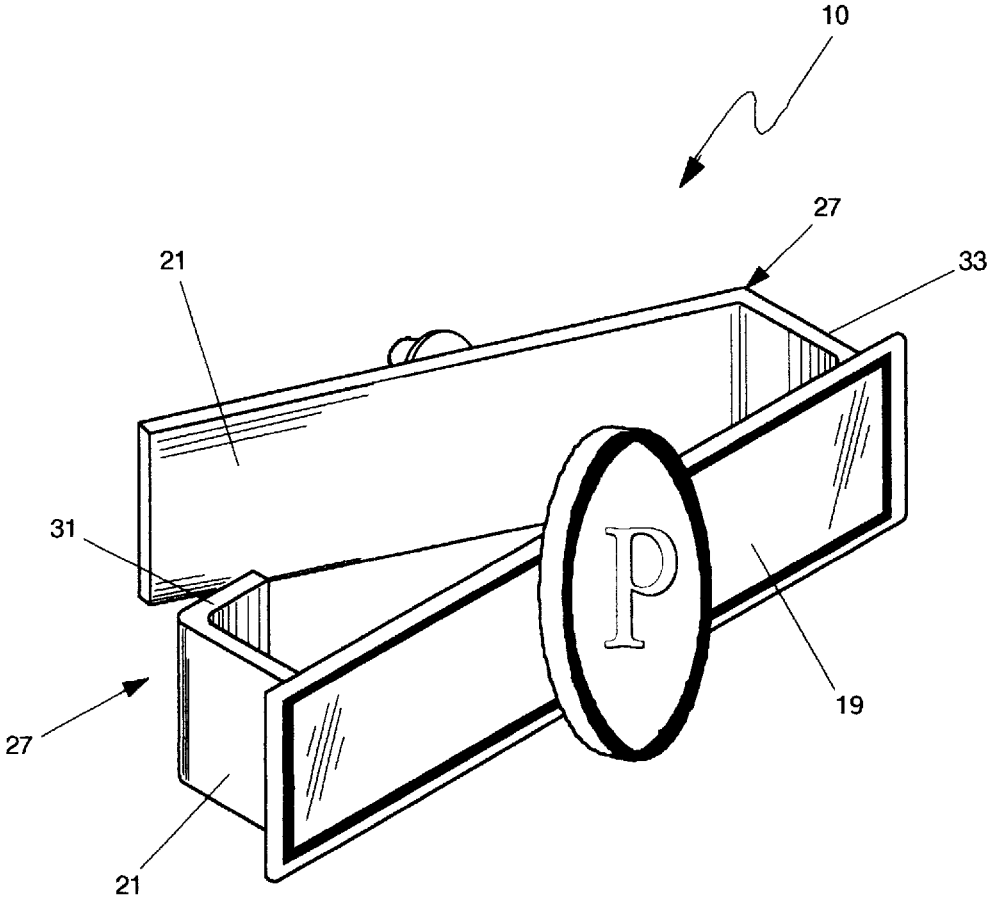
FIG. 1 is a perspective view of a non-penetrating tie restraining device according to the preferred embodiment of the present invention.

Referring now to FIG. 1, a tie restraining device, generally noted as 10, is shown, according to the preferred embodiment of the present invention. As is shown, an elongated tie restraining clamp 15 is provided for clipping around a tie in a non-penetrating manner, and supports a front member 17 having a surface capable of supporting a decorative fascia 19 being formed into a variety of styles and designs. It is envisioned that one such embodiment will include a clamp wherein the decorative fascia is formed as a decorative surface incorporated integrally with clamp front member. An example would be a front clamp member that has sufficient width and surface finish to allow a decorative image to be engraved directly within the surface. It is also envisioned that the tie restraining device will be capable of having a front member of a sufficient width and thickness as to incorporate a magnetic member within the front member. With such an embodiment, a decorative fascia formed of ferrous material can be magnetically adhered to the clamp front member. In such an embodiment, a number of decorative fascias of alternate designs and configurations can be easily applied and replaced, thereby giving the present invention the ability to conform to a number of different looks and styles. A clamp rear member 21 is held parallel to and offset from the clamp front member 17 by use of a first offset side member 23 and a second offset side member 25. The clamp rear member 21 is envisioned as an elongated, rigid rail affixed to the first offset side member 23 by a spring hinge means 27. The clamp rear member 21 also is envisioned as being lockable into a closed position by interaction with impingement lock means 31, herein depicted as a tab extending from and connected to the second offset side member 25 by a similar spring hinge means 27. It is envisioned that this second spring hinge means 27 can be optionally placed at either the front corner, between the second offset side member 25 and the clamp front member 17.

Figure 2A:
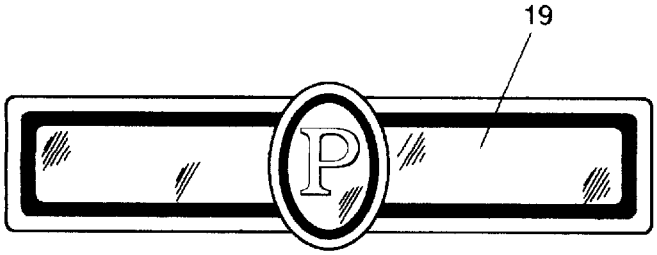
FIG. 2*a* is a front elevational view thereof.

Referring to FIG. 2*a,* the decorative fascia is shown in more detail. As shown, the decorative fascia 19 completely conceals the elongated clamp 15, and can be formed into a variety of styles. It is envisioned that a number of differently styled decorative fascias can be used interchangeably with the clamp 15.

Figure 2B:
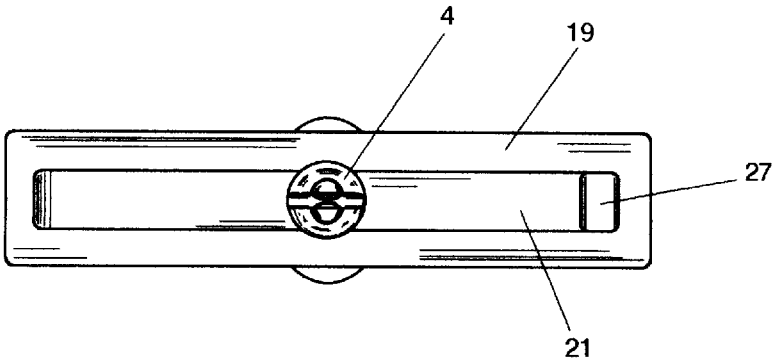
FIG. 2*b* is a rear elevational view thereof.
Figure 3A:
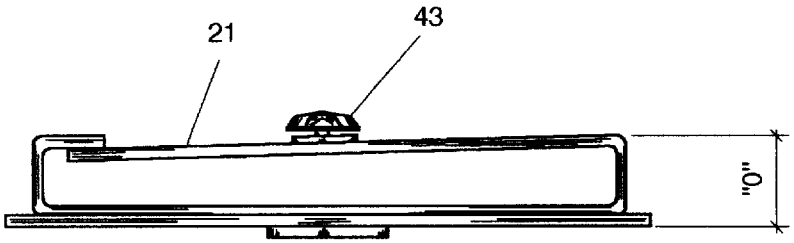
FIG. 3*a* is a top plan view thereof.
Figure 3B:
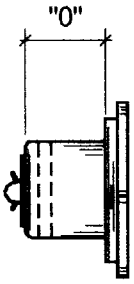
FIG. 3*b* is a side elevational view thereof.

Referring to FIG. 2*b,* a stick pin safety needle (shown more clearly in FIG. 3*a*) is shown covered with and protected by a safety needle cover 41. Further shown in the impingement locking means 31, wherein the clamp bar member 21 interacts with the tab extending form the spring hinge means 27. FIG. 3 shows this same overlap as well. Further shown is the safety stick pin 43 projecting perpendicularly outward from the back of the clamp rear member 21, with the needle cover affixed thereto. As shown in both FIG. 3*a* and FIG. 3*b,* the offset "O" is sufficient as to allow a normal necktie type neckwear pass through the clamp member while resting naturally and comfortably in a normal position, without binding or pulling.

2. Operation of the Preferred Embodiment

Figure 4:
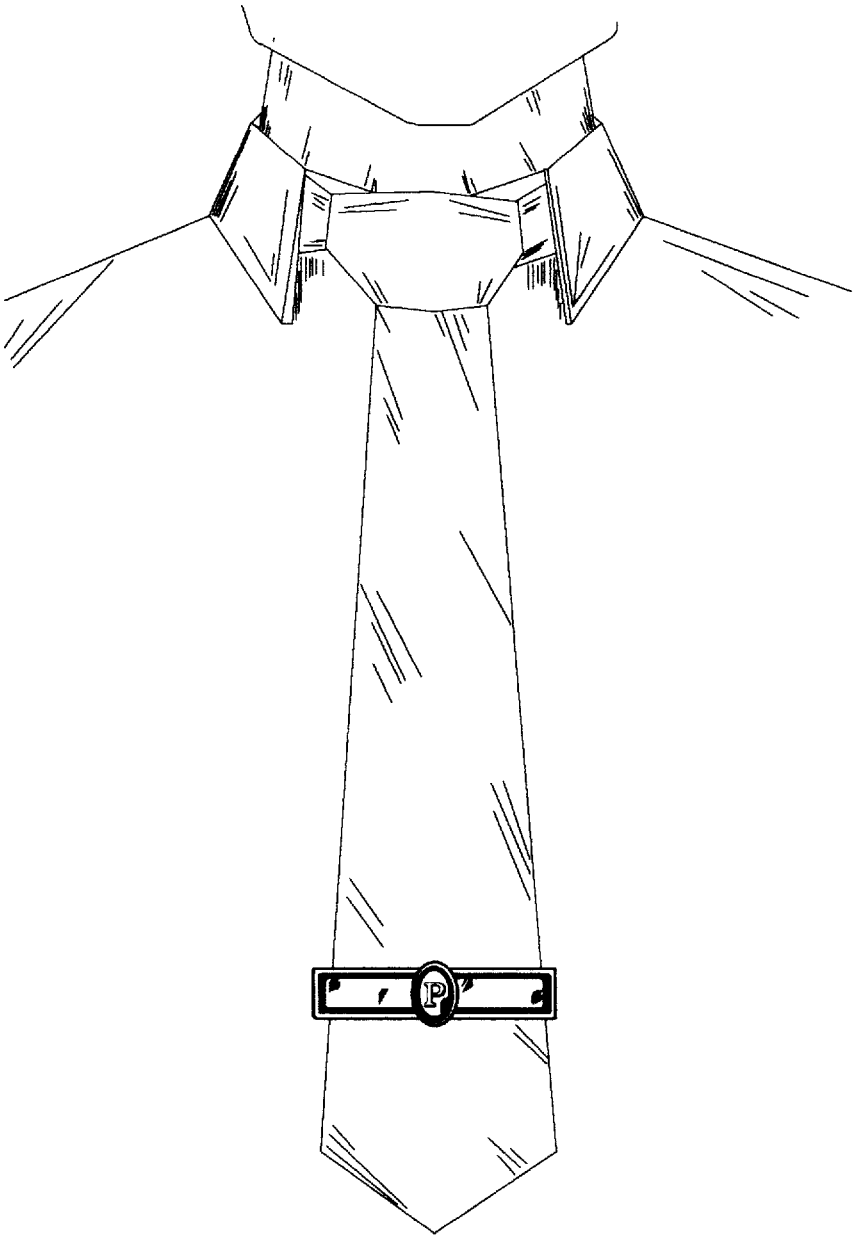
FIG. 4 is a front pictorial representation thereof shown in use with a standard necktie.

In operation, the present invention is shown in FIG. 4 in use with a normal necktie. In addition to allowing a normal necktie type neckwear pass through the clamp member while resting naturally and comfortably in a normal position, without binding or pulling, use of the present invention will keep the necktie linearly aligned in a vertical direction. To accomplish such, the elongated clamp 15 allows the tie to pass laterally between the front member and rear member, and horizontally between the respective side members. The tie restraining device 10 is then affixed to the user's shirt in an otherwise conventional manner via the stick pin needle 41.

The foregoing description is included to illustrate the operation of the preferred embodiment and is not meant to limit the scope of the invention. The scope of the invention is to be limited only by the following claims.

What is claimed is:

1. A tie restraining device for use with conventional neckwear, said tie restraining device comprising:

an elongated tie restraining clamp for clipping around a tie in a nonpenetrating manner, said restraining clamp including a clamp front member, a first offset side member affixed to and extending perpendicularly outward from said clamp front member, a second offset side member affixed to and extending perpendicularly outward from said clamp front member, and a clamp rear member held parallel to and offset from said clamp front member by said first offset side member by a spring hinge means;

a stick pin needle projecting perpendicularly outward from the back of the clamp rear member;

a safety needle cover for clamping to and covering said stick pin needle; and a decorative fascia affixed to said front member; and wherein said first offset side member and said second offset side member are of sufficient overall length such that said tie restraining device allows a normal necktie type neckwear pass into the orifice formed by said elongated tie restraining clamp while resting in a normal position without binding or pulling.

2. The tie restraining device of claim 1, further comprising an impingement locking means for closing said clamp rear member to said second offset side member.

3. The tie restraining device of claim 2, wherein said impingement locking meas comprises a tab extending from and connecting to said second offset side member.

4. The tie restraining device of claim 3, wherein said decorative fascia comprises a decorative surface incorporated integrally with said clamp front member.

5. The tie restraining device of claim 3, wherein said clamp front member is of a sufficient width in order to incorporate a magnetic member therein such that said decorative fascia can be magnetically adhered to said clamp front member.

* * * * *